United States Patent [19]

Gartner et al.

[11] Patent Number: 4,659,629

[45] Date of Patent: Apr. 21, 1987

[54] FORMATION OF A PROTECTIVE OUTER LAYER ON MAGNESIUM ALLOYS CONTAINING ALUMINUM

[75] Inventors: Charles D. Gartner; Patrick L. Hagans, both of Midland, Mich.

[73] Assignee: The Dow Chemical Company, Midland, Mich.

[21] Appl. No.: 801,352

[22] Filed: Nov. 25, 1985

[51] Int. Cl.[4] ..... B32B 15/04

[52] U.S. Cl. ..... 428/469; 148/13.1; 427/37; 427/377; 427/419.2; 427/435; 427/437; 428/701

[58] Field of Search ..... 148/13.1; 428/469, 701; 149/2; 427/37, 437, 435, 377, 419.2

[56] References Cited

U.S. PATENT DOCUMENTS 2,036,563 4/1936 Beck ..... 148/13.1
3,926,696 12/1975 Klunsch et al. ..... 149/2

FOREIGN PATENT DOCUMENTS 463024 3/1937 United Kingdom ..... 148/13.1
2066855 7/1981 United Kingdom ..... 148/13.1

OTHER PUBLICATIONS

D. Lovering et al, (2), Abstract No. 792, Extended Abstracts of the Electrochemical Soc. 83-1, Pennington, N.J., p. 1169.

Turner et al., Anodizing Aluminum in Molten Nitrates, Transactions of the Institute of Metal Finishing, pp. 109-115, May 1980.

*Primary Examiner*—Thomas J. Herbert

[57] ABSTRACT

A process is disclosed for the protection of magnesium based alloys containing aluminum by treatment with eutectic mixtures of fused salts to provide a corrosion resistant outer layer on the magnesium based alloy. A suitable fused salt mixture comprises urea and at least one of ammonium nitrate or ammonium nitrite. A magnesium based alloy is also disclosed comprising magnesium and aluminum having a corrosion resistant outer layer comprising magnesium oxide and aluminum oxide; the proportion of aluminum present in the outer layer being enriched in proportion to the amount present in the magnesium based alloy.

17 Claims, No Drawings

FORMATION OF A PROTECTIVE OUTER LAYER ON MAGNESIUM ALLOYS CONTAINING ALUMINUM

BACKGROUND OF THE INVENTION (1) Field of the Invention

The invention relates to the formation of a protective outer layer on magnesium based alloys containing aluminum in a process utilizing a eutectic mixture of a molten salt held at an elevated temperature.

(2) Description of the Prior Art

The formation of a protective outer layer by electrolytic or electroless means on magnesium based alloys containing aluminum utilizing a bath of a fused salt has attracted little attention during the past two decades. On the other hand, the anodizing of aluminum in molten salts, mainly nitrates, has attracted some attention. Some of this work has been reviewed in *Molten Salt Technology* edited by D. G. Lovering, Plenum, N.Y. (1982) and *Comprehensive Treatise of Electrochemistry* Vol. 7, edited by J. O'M. Bockris, B. Conway and E. Yeager, Plenum, N.Y. (1983). With respect to the anodizing of aluminum, Lovering and Clark, Abstract No. 792, Extended Abstracts of the Electrochemical Society 83-1, Pennington, N.J. describe the anodizing of aluminum in a molten salt eutectic mixture containing 40.4 mole percent ammonium nitrate with the balance urea.

The electrolytic production of protective layers on magnesium and magnesium based alloys utilizing low melting mixtures of polyfluoride such as those melting below about 125° centigrade, is disclosed in British Pat. No. 463,024. The heat treatment of magnesium alloys is disclosed in U.S. Pat. No. 2,036,563 utilizing a molten anhydrous compound consisting of sodium bichromate and potassium bichromate. There is also disclosed the prior art use of molten baths of potassium nitrate to anneal magnesium alloys.

There is no suggestion in these prior art references for the use of a low melting eutectic mixture of a nitrate or nitrate salt, an organic component, and water, specifically with a eutectic mixture of water, urea, and ammonium nitrate useful for the formation of a protective outer layer on a magnesium based alloy either by electrolytic means or electroless means.

SUMMARY OF THE INVENTION

A low melting eutectic mixture comprising an organic component such as urea and at least one of a nitrate or nitrite such as ammonium nitrate or ammonium nitrite, said mixture optionally containing water, is disclosed as useful in the formation of a protective outer layer on alloys containing magnesium and aluminum under electrolytic or electroless coating conditions. Suitable magnesium based alloys can contain about 1% to about 23% and preferably about 5% to about 20% by weight of aluminum. A useful eutectic mixture of urea and ammonium nitrate comprises 40.4 mole percent of ammonium nitrate and the balance urea and water.

DETAILED DESCRIPTION OF THE INVENTION

An alloy comprising magnesium and aluminum having a protective outer layer, preferably containing a major amount of magnesium, is disclosed together with a process for the formation of said protective outer layer on a magnesium based alloy containing aluminum under electrolytic or electroless coating conditions. A low melting eutectic mixture comprising urea and at least one of an ammonium nitrate or an ammonium nitrite has been found useful.

The present invention provides a process for the formation of a uniform, coherent, protective film on a magnesium based alloy containing aluminum thereby improving the corrosion resistance of the magnesium alloy. According to the present invention, the protective outer layer can be formed under anodizing magnesium conditions using an electrolyte comprising a eutectic mixture of an organic component such as urea and at least one of nitrate or ntirate such as ammonium nitrate or ammonium nitrite. Generally the eutectic mixture is held at an elevated temperature of about 50° to 85° centigrade during formation of the protective coating.

Under anodizing conditions, the magnesium based alloy is made the anode of an electrolytic cell containing the molten salt eutectic mixture electrolyte and a potential is applied between said anode and a cathod which does not contribute ions to the electrolyte, such as a cathode of iron or stainless steel. The cathode of the electrolytic cell can be of any suitable material which will not substantially dissolve in, react with, or otherwise interfere with the formation of a protective outer layer coating on the magnesium alloy. Such cathode materials include, in addition to iron and stainless steel, nickel, graphite or other conducting forms of carbon and mixtures containing conductive carbon, magnesium, chromium, silicon, mercury, sodium-mercury amalgum, platinum, gold, rhodium, silver, palladium, iridium, osmium, cobalt, and the like. Preferred cathode materials for use herein are iron and stainless steel. One skilled in the art will appreciate that the cathode of the electrolytic cell need not be in the form of an electrode element immersed in the electrolytic bath but can comprise the container for the electrolyte. Similarly should the magnesium alloy be utilized as the container for the electrolyte, a cathode in the form of a rod, bar, sheet, grid, or other suitable form can be dipped into the electrolyte.

It should be noted that a relatively low voltage difference is needed in the electrolytic cell in the inventive process for the formation of a protective outer layer on a mangesium based alloy containing aluminum utilizing a fused salt eutectic mixture, as disclosed herein. The useful anodizing voltages are in the range of about 0 to about +2.5 volts as determined using a 0.1 molar $AgNO_3/Ag$ reference electrode.

The prior art has indicated that the presence or absence of water in a fused bath eutectic mixture such as the ammonium nitrate-urea mixture found useful in the electrolytic bath has a critical effect in the anodization of titanium but is not critical in the anodization of aluminum and molybdenum. It was surprising to find that the presence of water in the fused salt eutectic mixture does not prevent the formation of an aluminum enriched passivating outer layer on the magnesium based alloy. A useful protective outer layer is formed as the result of exposing the magnesium based alloy to anodizing conditions utilizing the ammonium nitrate-urea molten salt described herein as an electrolyte at a temperature above its melting point.

In one embodiment of the process of the invention, the anode and cathode of the electrolytic cell are connected to an electrical power source and the voltage across the eutectic mixture electrolyte is gradually increased until a passivating outer layer has formed. Both direct and alternating current can be used to establish the electrical potential across the electrolyte bath between the cathode and the anode of the cell. Alternating current can be used because of the rectifying effect of magnesium as an anode. However, the use of direct current is preferred.

Exposure to either anodizing or electroless coating conditions are relatively fast means of forming a protective outer layer on a magnesium based alloy containing aluminum. The anodizing conditions can include application of a potential of 1 volt positive of the rest potential of the system, for about 2 to 20 minutes, preferably 3 to 7 minutes wherein the low melting eutectic mixture is held at a temperature of between 50° centigrade to 85° centigrade.

As an alternative to the formation of a protective outer layer on the magnesium based alloy under anodizing conditions, a protective outer layer can be formed on said alloy simply by dipping the metal into the molten eutectic mixture described herein. In this process, under electroless coating conditions, the magnesium based alloy containing aluminum is exposed to electroless coating conditions generally at a temperature above the melting point of the eutectic mixture and preferably in the range of about 43.5° centigrade to about 125° centigrade. Most preferably, a temperature of about 50° to about 85° centigrade is utilized during exposure of the magnesium based alloy to the electroless coating conditions of one embodiment of the process of the invention. The molten fused salt bath can contain small amounts of water without deleteriously affecting the formation of a protective outer layer on the magnesium based alloy. Small amounts of water absorbed from the atmosphere in the amounts of about 0.01 weight percent to about 1 weight percent and up to about 5 weight percent can be present in the eutectic mixture.

An important discovery with respect to the formation of a protective outer layer on a magnesium alloy containing aluminum under electroless coating conditions was found to be the fact that formation of a protective outer layer can take place without prior cleaning of the magnesium alloy surface. Thus the conventional cleaning treatments of the metal prior to exposure to electroless coating conditions, utilizing aqueous solutions of sodium hydroxide or phosphoric acid, are not required to obtain satisfactory protective outer layers on the magnesium based alloy.

Analysis of the protective outer layer applied to the mangesium based alloy containing aluminum has indicated that it is composed of aluminum oxide and magnesium oxide with the aluminum oxide predominating. It is believed that enrichment of the surface coating with respect to aluminum oxide is the result of the higher rate at which magnesium oxide dissolves into the fused salt eutectic mixture utilized in the process of the invention. One effect of small amounts of water in the eutectic mixture was found to be an increase in the current density during the anodization process.

The following examples illustrate the various aspects of the invention but are not intended to limit its scope. Where not otherwise specified throughout this specification and claims, temperatures are given in degrees centigrade, and parts, percentages, and proportions are made by weight.

EXAMPLE 1

Protective outer layers were formed with improve the corrosion resistance of a magnesium-aluminum-zinc alloy containing 9% by weight aluminum and 1% by weight zinc in accordance with a process of the invention as follows: the sample of magnesium based alloy was cleaned either by mechanical polishing or by a conventional pickling procedure utilizing sodium hydroxide or phosphoric acid solutions. The cleaning procedure was followed by a simple dipping procedure in which the sample of magensium based alloy was dipped into a molten salt eutectic mixture held at a temperature of 60° C. The eutectic mixture consisted of 40.4 mole percent ammonium nitrate in combination with urea. This eutectic mixture has a melting point of about 43.5° centigrade and a useful molten range of about 50° centigrade to about 85° centigrade. Subsequent to dipping the magnesium based alloy in the eutectic mixture, the sample was withdrawn from the mixture and heated with a stream of air at a temperature of about 80° centigrade to about 90° centigrade. The sample was rinsed with water either immediately after being withdrawn from the molten salt mixture or after the sample has cooled.

EXAMPLE 2

Utilizing the same magnesium based alloy as described in Example 1 and the same cleaning procedure described in Example 1, the magnesium based alloy was utilized as the anode in an electrochemical cell having a platinum cathode and utilizing the eutectic mixture described in Example 1 as the electrolyte. The anode was exposed to anodizing conditions of one volt positive of the rest potential, as determined using a 0.1 molar $AgNO_3/Ag$ reference electrode, for at least five minutes while holding the eutectic mixture at a temperature of about 60° centigrade.

EXAMPLE 3

Following the same procedure as in Example 1 except that the cleaning procedure is eliminated and the eutectic mixture is held at a temperature of about 85° centigrade, a protective outer layer was applied to the magnesium based alloy by dipping the alloy into the eutectic mixture and holding the alloy in contact with the eutectic mixture for a period of five minutes.

Corrosion rates and pitting potential on each of the three samples made in the above Examples were evaluated by Linear Sweep Voltammetry. The testing solution used was a buffered aqueous solution having a pH of 9.3 containing one thousand parts per million of sodium chloride. In this solution, the protective outer layer on the magnesium based alloy formed under anodizing conditions provided nearly a factor of four decrease in the corrosion rate (as monitored by current density) and approximately a 0.3 volt increase in the range of uniform corrosion before pitting corrosion predominates. Comparable results for Example 1 and 2 are: Example 1, factor of three decrease and a 0.6 volt increase; Example 2, factor of 8 decrease and 0.4 volt increase.

While this invention has been described with reference to certain specific embodiments, it will be recognized by those skilled in the art that many variations are possible without departing from the scope and spirit of the invention, and it will be understood that it is intended to cover all changes and modifications of the invention disclosed herein for the purposes of illusration which do not constitute departures from the spirit and scope of the invention.

The embodiments of the invention in which an exclusive property or privilege is claimed are defined as follows:

1. A magnesium based alloy containing a minor amount of aluminum having an outer layer comprising aluminum oxide and magnesium oxide prepared by exposing said alloy to electroless coating conditions in the presence of a molten fused salt eutectic mixture comprising an organic component and at least one of a nitrate or nitrite, wherein the proportion of aluminum present in said outer layer is enriched in proportion to the amount of aluminum present in said magnesium based alloy.

2. The composition of claim 1 wherein said organic component of said eutectic mixture comprises urea, said nitrate salt is ammonium nitrate, and said eutectic mixture contains water.

3. The composition of claim 2 wherein said eutectic mixture contains 40.4 mole percent ammonium nitrate.

4. The composition of claim 3 wherein the proportion of water in said eutectic mixture is about 0.01 to about 5 weight percent.

5. The composition of claim 4 wherein the proportion of aluminum in said alloy is about 5% to about 20% by weight.

6. The composition of claim 5 wherein said alloy contains 9% aluminum and 1% zinc.

7. The composition of claim 5 wherein the proportion of aluminum present in said outer layer is a predominating proportion.

8. A magnesium based alloy containing a minor amount of aluminum having an outer layer comprising aluminum oxide and magnesium oxide prepared by exposing said alloy to electrolytic coating conditions in the presence of a molten fused salt eutectic mixture comprising an organic component and at least one of a nitrate or nitrite and wherein the proportion of aluminum present in said outer layer is enriched in proportion to the amount of aluminum present in said magnesium based alloy.

9. The composition of claim 8 wherein said organic component of said eutectic mixture comprises urea, said nitrate salt is ammonium nitrate, and said eutectic mixture contains water.

10. The composition of claim 9 wherein said eutectic mixture contains 40.4 mol percent ammonium nitrate.

11. The composition of claim 10 wherein the proportion of water in said eutectic mixture is about 0.01 to about 5 weight percent.

12. The composition of claim 11 wherein the proportion of aluminum in said alloy is about 5% to about 20% by weight.

13. The composition of claim 12 wherein said alloy contains 9% aluminum and 1% zinc.

14. The composition of claim 12 wherein the proportion of aluminum present in said outer layer is a predominating proportion.

15. A process for producing a corrosion resistant outer layer on a magnesium based alloy containing a minor amount of aluminum, said process comprising:

(A) exposing said alloy to electroless coating conditions in the presence of an eutectic mixture at a temperature above the melting point of said eutectic mixture, or (B) exposing said alloy to electrolytic coating conditions in the presence of an eutectic mixture and at a temperature above the melting point of said eutectic mixture, and (C) forming an outer layer comprising aluminum oxide and magnesium oxide wherein the proportion of aluminum present in said outer layer is enriched in proportion to the amount present in said alloy , and wherein said eutectic mixture comprises an organic component and at least one of a nitrate or nitrite.

16. The process of claim 15 wherein said eutectic mixture comprises water, urea, and at least one of an ammonium nitrate or nitrite fused salt.

17. The process of claim 16 wherein said eutectic mixture contains 40.4 mol percent by weight of ammonium nitrate and said outer layer is formed on said alloy at a temperature of about 50° centigrade or 85° centigrade wherein the proportion of aluminum present in said outer layer is a predominating proportion.

* * * * *